US008500224B2

(12) United States Patent
Moeller

(10) Patent No.: US 8,500,224 B2
(45) Date of Patent: Aug. 6, 2013

(54) REFRIGERATED CABINET WITH DOOR ASSEMBLY

(75) Inventor: Erik Moeller, Cologne (DE)

(73) Assignee: Remis Gesellschaft fuer Entwicklung und Vertrieb Technischer Elemente mbH, Cologne (DE)

( * ) Notice: Subject to any disclaimer, the term of this patent is extended or adjusted under 35 U.S.C. 154(b) by 0 days.

(21) Appl. No.: 13/006,582

(22) Filed: Jan. 14, 2011

(65) Prior Publication Data

US 2011/0175509 A1 Jul. 21, 2011

(30) Foreign Application Priority Data

Jan. 18, 2010 (DE) ..... 10 2010 004 950

(51) Int. Cl.
*A47B 96/04* (2006.01)

(52) U.S. Cl.
USPC ..... 312/405; 312/322; 312/324

(58) Field of Classification Search
USPC ..... 312/322–324, 114, 405; 49/176, 49/177, 178, 152
See application file for complete search history.

(56) References Cited

U.S. PATENT DOCUMENTS

| | | | | | |
|---|---|---|---|---|---|
| 2,669,499 | A * | 2/1954 | Vanderplank | 312/322 |
| 2,936,206 | A * | 5/1960 | Wilmer et al. | 312/322 |
| 3,017,233 | A * | 1/1962 | Gates | 312/322 |
| 4,641,896 | A * | 2/1987 | Iimura et al. | 312/110 |
| 5,108,165 | A * | 4/1992 | Rorke et al. | 312/322 |
| 5,657,743 | A * | 8/1997 | Schwarzbacker et al. | 126/194 |
| 5,765,263 | A * | 6/1998 | Bolinas et al. | 16/342 |
| 6,056,376 | A * | 5/2000 | Yenglin et al. | 312/139.1 |
| 6,375,291 | B1 * | 4/2002 | Nam et al. | 312/405 |
| 6,682,159 | B2 * | 1/2004 | Compagnucci | 312/334.24 |
| 6,848,758 | B1 * | 2/2005 | Yeh et al. | 312/258 |
| 7,959,242 | B2 * | 6/2011 | Del Castillo | 312/322 |
| 2004/0232810 | A1 * | 11/2004 | Kreyenkamp | 312/322 |
| 2007/0159037 | A1 * | 7/2007 | Hoffman | 312/322 |

* cited by examiner

*Primary Examiner* — Darnell Jayne
*Assistant Examiner* — Andres F Gallego
(74) *Attorney, Agent, or Firm* — Norman B. Thot

(57) ABSTRACT

A refrigerated cabinet includes a door assembly for closing a cooling chamber. The door assembly includes a door supported by pivot bearings being configured to pivot about a vertical axis between a closed position and an opened position. Rails arranged substantially parallel to a side wall of the refrigerated cabinet are configured to displaceably support the pivot bearings of the door. The door is displaceable in the rails between a use position in front of the cooling chamber, in which the door is pivotable between the opened position and the closed position, and a parking position next to the cooling chamber, in which the door cannot be pivoted.

21 Claims, 4 Drawing Sheets

REFRIGERATED CABINET WITH DOOR ASSEMBLY

CROSS REFERENCE TO PRIOR APPLICATIONS

Priority is claimed to German Patent Application No. DE 10 2010 004 950.6, filed Jan. 18, 2010. The entire disclosure of said application is incorporated by reference herein.

FIELD

The present invention relates to a refrigerated cabinet comprising a cooling chamber accessible from the front and to a door assembly which can be retrofitted to such a refrigerated cabinet.

BACKGROUND

In stores, refrigerated sales goods are stored and presented in refrigerated sales cabinets. For removal of goods, the refrigerated cabinet comprises an access opening arranged in a vertical opening plane, the cooling chamber being subdivided into separate individual bins by means of shelf boards arranged vertically above each other. Such cooling cabinets are sufficiently known from the state of the art, notably those of the type having an open-fronted cooling chamber as well as those of the type provided with pivotable doors for forming a cooling chamber which is closed on all sides, the latter type allowing for economically favorable storage of goods at a temperature below +5° C.

In conventional refrigerated cabinets which are open during shop hours so that customers can have unobstructed access to the sales goods, the cooling air generated within the refrigerated cabinet is supplied into the cooling chamber through the rear wall of the cabinet in an undirected manner. A so-called cold-air curtain further streams at a relatively high speed within the access opening of the refrigerated cabinet from the upper end to the lower end of the cabinet. This well-directed cold air flow forms an invisible curtain between the cooled air volume within the cooling chamber and the warmer ambient air. On the whole, such refrigerated cabinets produce high energy losses.

Only outside of store operating hours, in order to save costs and energy, that the open cooling chamber of such refrigerated cabinets will be closed by corresponding night covers. Such a night cover is normally provided as a roller blind which in its non-use position is wound into a roll arranged in the upper region of the refrigerated cabinet. At the end of the store hours, the roller blind will be manually or automatically moved, particularly shifted, into a cover position, thus closing the cooling chamber of the refrigerated cabinet against the warmer ambient air.

Other refrigerated cabinets provide doors for closing the cooling chamber, which are pivotable about a vertical line for opening the chamber. In contrast to pen-fronted refrigerated cabinets, energy is thereby also saved during store operating hours. However, such closed doors tend to have a negative effect on the visibility of the sales goods in the refrigerated cabinet. The customer must also open at least one door to be able to remove the presented goods from within the refrigerated cabinet. This may cause a reduction of turnover sales during peak store operating hours.

SUMMARY

An aspect of the present invention is to provide a refrigerated cabinet and a door assembly for the refrigerated cabinet which can be operated in a flexible and energy-saving manner.

In an embodiment, the present invention provides a refrigerated cabinet which includes a door assembly for closing a cooling chamber. The door assembly includes a door supported by pivot bearings configured to pivot about a vertical axis between a closed position and an opened position. Rails arranged substantially parallel to a side wall of the refrigerated cabinet are configured to displaceably support the pivot bearings of the door. The door is displaceable in the rails between a use position in front of the cooling chamber, in which the door is pivotable between the opened position and the closed position, and a parking position next to the cooling chamber, in which the door cannot be pivoted.

BRIEF DESCRIPTION OF THE DRAWINGS

The present invention is described in greater detail below on the basis of embodiments and of the drawings in which.

DETAILED DESCRIPTION

Figure 1:
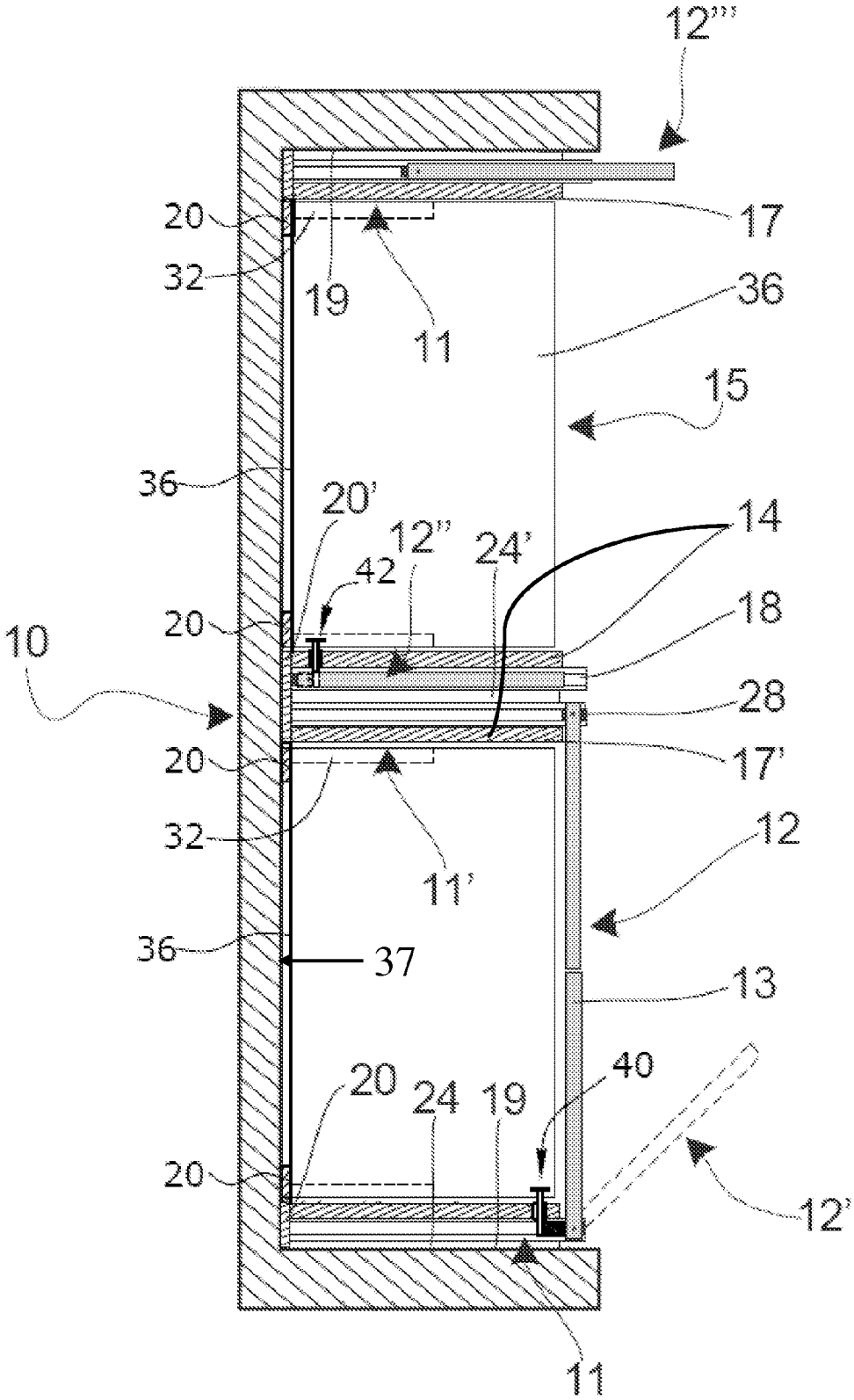
FIG. 1 shows a cross-sectional view of a refrigerated cabinet with retrofitted door assembly.

The refrigerated cabinet of the present invention comprises a door assembly provided with two rails arranged substantially parallel to a side wall of the refrigerated cabinet. The door assembly further comprises a door which by means of two pivot bearings is supported to be pivoted about its vertical axis, the pivot bearings being displaceably supported in the two rails.

The door can be displaced between a use position in front of the cooling chamber, in which the door is pivotable about the vertical axis between an opened position and a closed position, and a parking position adjacent to the cooling chamber, in which the door is arranged non-pivotally between the rails laterally of the cooling chamber. Starting from the opened position, the door can be displaced along the depth dimension of the refrigerated cabinet in a direction parallel to the side of the cooling chamber. In the use position, the door can be pivoted into an opened position so that goods can be removed from within.

Since, during peak hours, the doors in their use position tend to dampen the customers' inclination to buy, which is undesired, the doors can during these periods be stored fully and in a place-saving manner in a parking position to the side of the cooling chamber, so that the refrigerated cabinet is permanently open towards the front and the customer has unhindered access to the goods.

In order to prevent that the door from being shifted either accidentally or due to unauthorized tampering, for example, from the opened state of the use position into the parking position and vice versa, the door can, for example, be lockable both in the use position and in the parking position.

In an embodiment of the present invention, the rails of the door assembly can be formed as grooves. An advantageous design in this regard is, for example, a U-shaped groove. Each rail can also be provided with a slider displaceably arranged therein, the slider comprising the pivot bearings of the door and preventing the door from becoming wedged in the process of being displaced. The slider can, for example, be supported by slide bearings or rolling bearings.

In an embodiment of the present invention, the door assembly can comprise a cassette structure with a C-shaped frame. The frame can, for example, be composed of a horizontal upper frame portion and a horizontal lower frame portion which are connected to each other via a vertical connection portion. The vertical connection portion can also serve as a carrier member for the holding supports of the shelf boards and, on the side facing toward the cooling chamber, be fastened to the rear wall of the cabinet in the areas between the cabinet segments, wherein a given cabinet segment corresponds to the length of a shelf board.

The frame can also comprise a side wall. Apart from its function for spatial separation between the cabinet segments, the side wall can also provide protection from contamination and, in the use position of the door, is effective to prevent goods from dropping into the cassette structure. The side wall can also stabilize the frame.

In case of a refrigerated cabinet having an elongated design as depicted in FIG. 1 and comprising a sole elongated cooling chamber, it is possible, by insertion of a two-part cassette structure, to subdivide the cooling chamber into two cabinet segments containing one cooling partial chamber, respectively. The dual cassette structure can be designed so that the frame carries a door on each side of the cooling partial chamber.

To make it possible to withdraw the door fully into the frame of the cassette structure, it can be advantageous if the width of the door is not larger than the depth of the refrigerated cabinet.

In an embodiment of the present invention, the door assembly can comprise a self-locking mechanism which in the use position is operative, for example, in a situation where the door opening angle is smaller than 30°, to automatically move the door into the closed position. If the door is in its use position in which the door, whenever required, can be opened and then be shut again, it may happen that the consumer, after he/she has removed the desired goods, leaves the door open or only "slams" the door so that the door does not entirely close. This in turn will cause an undesired increase of energy consumption. The self-locking mechanism will, however, force the door into the locked position.

In an embodiment of the present invention, a door assembly can be adapted to be retrofitted to an existing open-fronted refrigerated cabinet which can completely close an open-fronted refrigerated cabinet with doors.

A door assembly can thus be retroactively installed on existing conventional refrigerated cabinets, for example, open refrigerated cabinets, wherein the door assembly will provide energy savings and easy accessibility when required.

The embodiments of the present invention will be explained in greater detail hereunder with reference to the accompanying drawings.

In FIG. 1, a refrigerated cabinet 10 is shown in a horizontal sectional view. For removal of sales goods, the refrigerated cabinet 10 comprises an access opening arranged in a vertical access plane. A refrigerated cabinet of this type is suited particularly for storage of goods at a cooling temperature of +0 to +10° C. The elongate cooling chamber 15 arranged within the refrigerated cabinet 10 is divided into individual bins by means of shelf boards 36 arranged above each other in the vertical direction.

By the central arrangement of a door assembly 11' on the cabinet rear wall 37 of refrigerated cabinet 10, the refrigerated cabinet 10 is subdivided into two cabinet segments, wherein a cabinet segment is sized to extend substantially along the length of a shelf board 36. Each cabinet segment comprises a cooling chamber 15 of its own. Between the inner side of the refrigerated cabinet's side wall 19 and the respective cooling chamber 15, door assemblies 11 are arranged so that the open-fronted refrigerated cabinet 10 can be completely closed by a total of four doors 12, 12', 12", 12'" of the door assemblies 11,11'.

Depending on the length of a refrigerated cabinet 10, also further door assemblies 11' can be mounted to the rear wall 37 of the cabinet, thus making it possible to form a larger number than the two cabinet segments of the exemplary embodiment shown in FIG. 1. The shelf boards 36 should be correspondingly adapted to the length of the cabinet segment.

The door assemblies 11 arranged on the inner side of the refrigerated cabinet's side wall 19 comprise a one-part cassette structure 17 on the side facing toward cooling chamber 15. The one-part cassette structure 17 comprises a door 12 and a cassette side wall 14 arranged between the door 12 and the cooling chamber 15.

Door assembly 11' comprises a two-part cassette structure 17'. In contrast to the above described one-part cassette structure 17, door assembly 11' comprises two doors 12 guided in corresponding rails 16,18, the doors 12 being arranged between two cassette side walls 14.

In the left-hand cabinet segment in FIG. 1, the door assembly 11 is shown in the use position. The two doors 12 of the left-hand cabinet segment are arranged in the closed position in which the doors 12,12' can be pivoted about their vertical axes. Each door 12 can, for example, comprise a large-surfaced glass pane 13 held in a narrow enclosing frame so that the sales goods can be conveniently visible. In the right-hand cabinet segment, the door 12" of the central door assembly 11' is shown in the parking position and the other door 12'" is shown during its advancement into the parking position.

Figure 2:
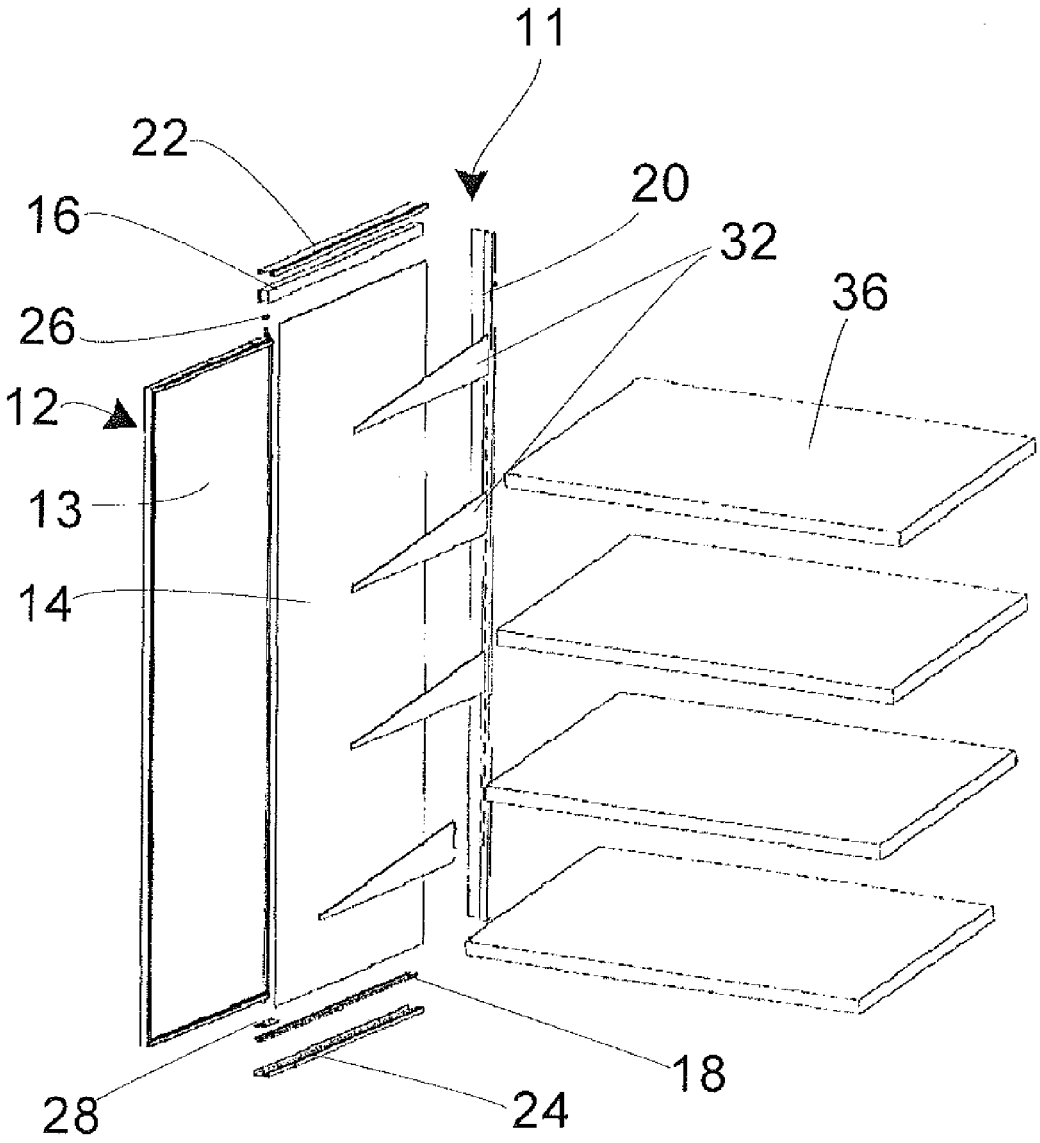
FIG. 2 shows an exploded view of a door assembly of a one-part design, provided for the left-hand side of the refrigerated cabinet shown in FIG. 1.

FIG. 2 shows an exploded view of door assembly 11 formed as a one-part cassette structure 17, as arranged on the inner sides of the refrigerated cabinet's side walls 19 in FIG. 1. The one-part cassette structure 17 comprises a frame 20,22, 24, the latter being designed as an assembly comprising a horizontal upper frame portion 22, a horizontal lower frame portion 24 and a vertical connection portion 20. Together with the frame portions 22,24, the connection portion 20 forms a C-shaped frame 20,22,24 having inner dimensions selected to be large enough to allow the frame 20,22,24 to fully accommodate the door 12 and the cassette side wall 14.

The connection portion 20 further comprises receiving portions for holding bars 32 for the shelf boards 36.

On the mutually confronting inner sides of the frame portions 22,24, rails 16,18 are arranged for sliding support of a slider 28 guided therein. The slider 28 receives the door 12 via a pivot bearing 26 so that the door, when in its use position, is supported in a manner allowing also pivoting movements.

For guiding the slider 28, the rails 16,18 are of a U-shaped configuration, while, however, other embodiments are also possible. In the embodiment depicted in FIG. 2, the upper rail 16 is open in the downward direction and the lower rail 18 is open in the upward direction. In this arrangement, the slider 28 comprise slide bearings or rolling bearings. To achieve a good guidance during sliding movement of door 12, the sliders 28 of a door assembly 11 can be coupled to cable-type pull devices so that the movement of sliders 28 will always be synchronized with each other.

Figure 3:
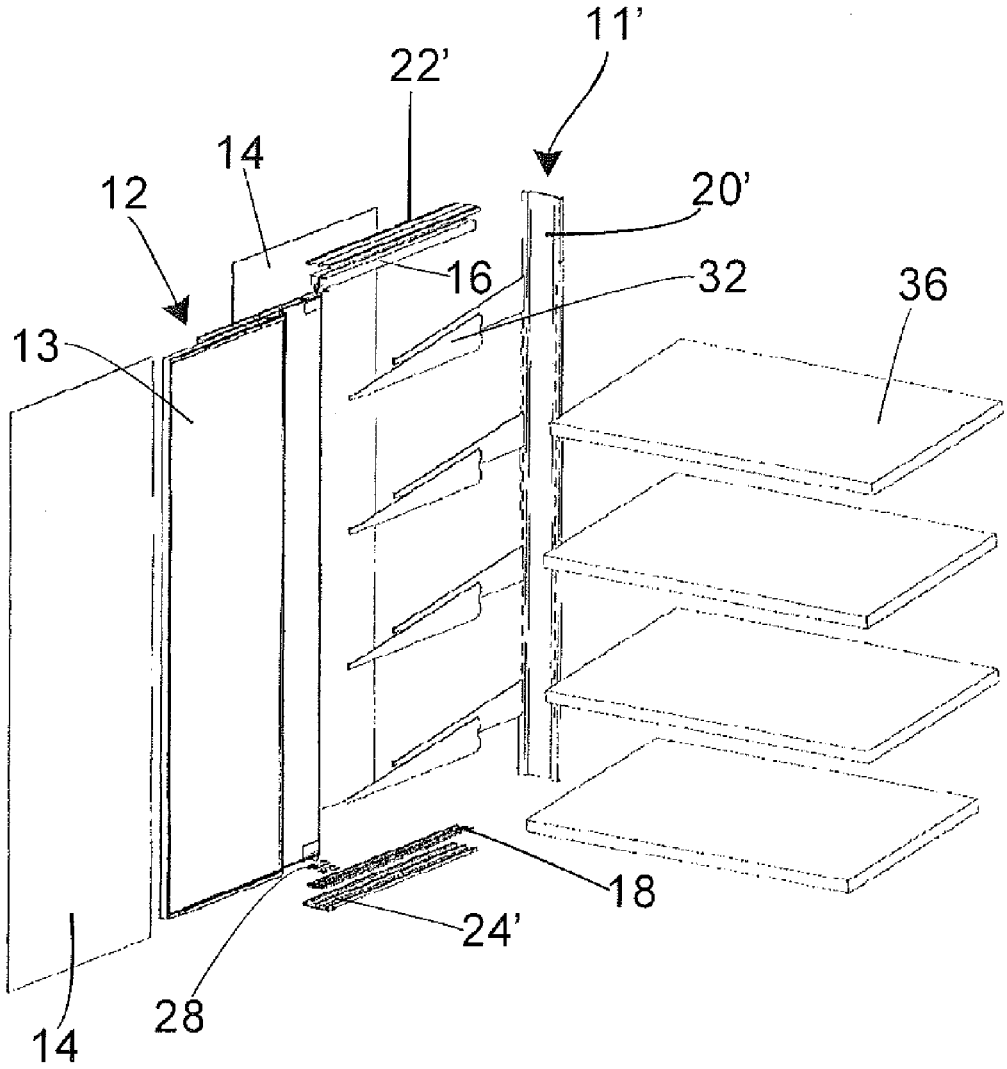
FIG. 3 shows an exploded view of a door assembly of a two-part design, to be mounted between two cabinet segments of the refrigerated cabinet shown in FIG. 1.

Also FIG. 3 is an exploded view of a door assembly 11' according to the invention. This door assembly 11', however, comprises a two-part cassette structure 17' and can be mounted between two cabinet segments, as shown in FIG. 1. In contrast to the one-part cassette structure 17 of FIG. 2, the rails 16,18 on the mutually confronting inner sides of the frame portions 22',24' are provided in a dual configuration so that two doors 12 are received parallel to each other in the two-part cassette structure 17'.

Figure 4:
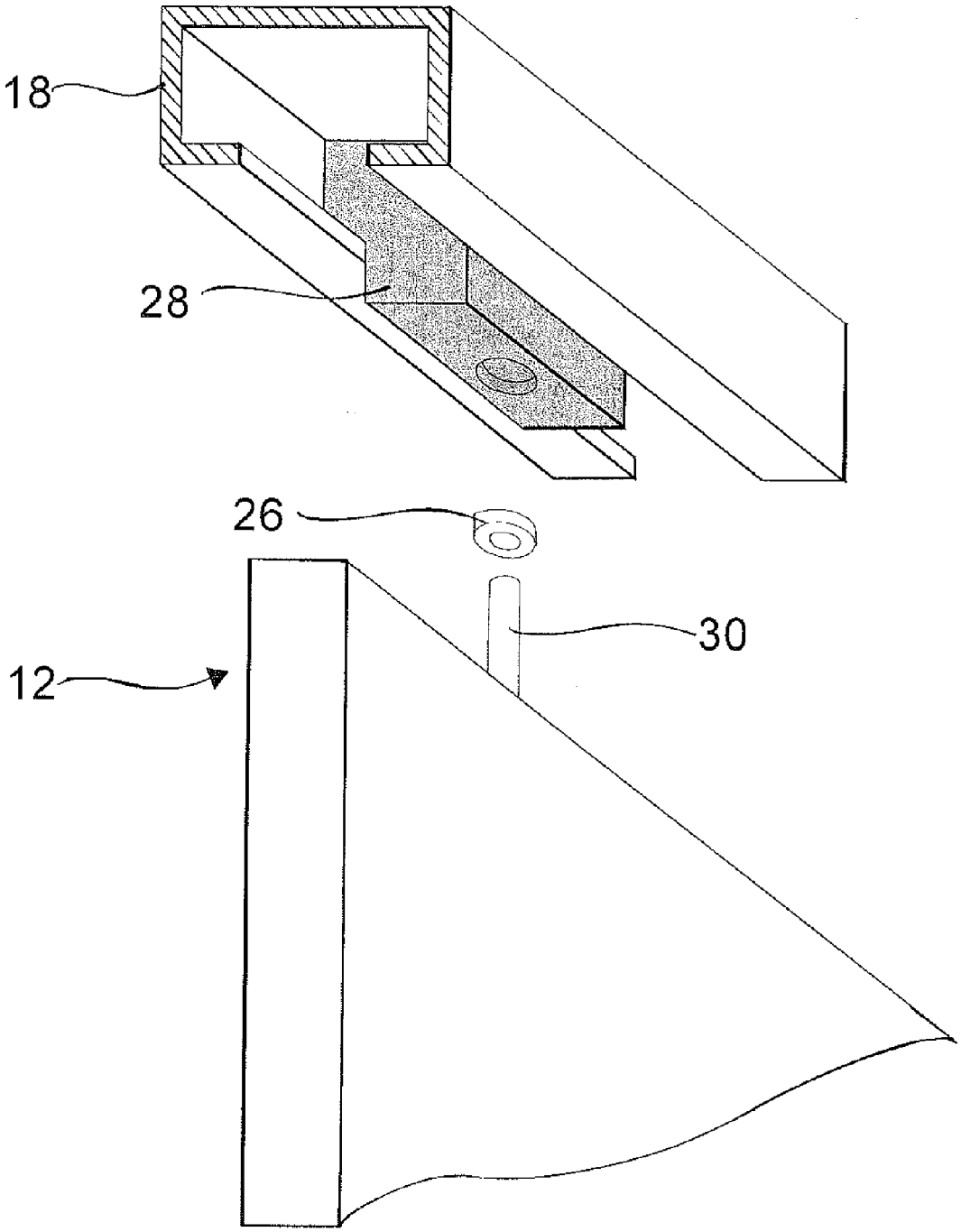
FIG. 4 shows a detailed view of the bearing support of the slider in the upper rail.

FIG. 4 is a detailed view of a further advantageous embodiment of the rail. The rail 16 herein is undercut to form a nearly C-shaped groove, thus providing for stable guidance and an undetachable hold of slider 28. Door 12 comprises a vertical bearing support pin 30 inserted into a vertical bore of pivot bearing 26 and forming the rotary axis of door 12.

The present invention is not limited to embodiments described herein; reference should be had to the appended claims.

What is claimed is:

1. A combination of a door assembly and an open-fronted showcase refrigerated cabinet for stores, the combination comprising:

the open-fronted showcase refrigerated cabinet for stores comprising a cooling chamber with side walls arranged parallel to each other, a rear wall arranged perpendicular to each of the side walls, and shelves fixedly arranged between the side walls; and the door assembly comprising:

at least one one-part cassette structure comprising:

a horizontal upper frame portion and a horizontal lower frame portion, the horizontal upper frame portion and the horizontal lower frame portion being connected to each other via a vertical connection portion, a door supported by pivot bearings, the door being configured to pivot about a vertical axis between a closed position and an opened position, and rails arranged substantially parallel to the side walls of the open-fronted showcase refrigerated cabinet for stores, the rails being configured to displaceably support the pivot bearings; and at least one two-part cassette structure comprising:

a horizontal upper frame portion and a horizontal lower frame portion, the horizontal upper frame portion and the horizontal lower frame portion being connected to each other via a vertical connection portion, two doors supported by respective pivot bearings, the two doors each being configured to pivot about a vertical axis between a closed position and an opened position, and rails arranged substantially parallel to the side walls of the open-fronted showcase refrigerated cabinet for stores, the rails being configured to displaceably support the pivot bearings, wherein, each door is displaceable in the rails between a use position in front of the open-fronted showcase refrigerated cabinet for stores, in which each door is pivotable between the opened position and the closed position, and a parking position to the side of the open-fronted showcase refrigerated cabinet for stores, in which each door cannot be pivoted, wherein, the door assembly is connected to the open-fronted showcase refrigerated cabinet for stores, wherein, the shelves are fixedly arranged between the at least one one-part cassette structure and the at least one two-part cassette structure; and wherein each vertical connection portion comprises a receiving portion holding bars on which the shelves are mounted.

2. The combination as recited in claim 1, wherein the rails each include a U-shaped groove configured to guide the pivot bearings.

3. The combination as recited in claim 1, wherein the pivot bearings of the doors each include a slider which is configured to be guided in a groove of the rails.

4. The combination as recited in claim 1, wherein each of the one-part cassette structure and the two-part cassette structure further include a side wall on a side facing toward the cooling chamber.

5. The combination as recited in claim 1, wherein a width of the doors is not larger than a depth of the cooling chamber.

6. The combination as recited in claim 1, wherein the at least one one-part cassette structure is attached to at least one of the side walls of the cooling chamber and the rear wall of the open-fronted showcase refrigerated cabinet for stores, and the at least one two-part cassette structure is attached to the rear wall of the open-fronted showcase refrigerated cabinet for stores.

7. The combination as recited in claim 6, wherein the at least one one-part cassette structure and the at least one two-part cassette structure are attached to the open-fronted showcase refrigerated cabinet for stores via their respective vertical connection portion.

8. A combination of a door assembly and an open-fronted showcase refrigerated cabinet for stores, the combination comprising:

the open-fronted showcase refrigerated cabinet for stores comprising a cooling chamber with side walls arranged parallel to each other, a rear wall arranged perpendicular to each of the side walls, and shelves fixedly arranged between the side walls; and the door assembly comprising at least one one-part cassette structure comprising:

a horizontal upper frame portion and a horizontal lower frame portion, the horizontal upper frame portion and the horizontal lower frame portion being connected to each other via a vertical connection portion, a door supported by pivot bearings, the door being configured to pivot about a vertical axis between a closed position and an opened position, and rails arranged substantially parallel to the side walls of the open-fronted showcase refrigerated cabinet for stores, the rails being configured to displaceably support the pivot bearings;

wherein, the door is displaceable in the rails between a use position in front of the open-fronted showcase refrigerated cabinet for stores, in which the door is pivotable between the opened position and the closed position, and a parking position to the side of the open-fronted showcase refrigerated cabinet for stores, in which the door cannot be pivoted, wherein, the door assembly is connected to the open-fronted showcase refrigerated cabinet for stores, wherein, the shelves are fixedly arranged between the at least one one-part cassette structure and at least one of the side walls; and wherein the vertical connection portion comprises a receiving portion holding bars on which the shelves are mounted.

9. The combination as recited in claim 8, wherein the rails each include a U-shaped groove configured to guide the pivot bearings.

10. The combination as recited in claim 8, wherein the pivot bearings of the door include a slider which is configured to be guided in a groove of the rails.

11. The combination as recited in claim 8, wherein the at least one one-part cassette structure further comprises a side wall on a side facing toward the cooling chamber.

12. The combination as recited in claim 8, wherein a width of the door is not larger than a depth of the cooling chamber.

13. The combination as recited in claim 8, wherein the at least one one-part cassette structure is attached to at least one of the side walls and the rear wall of the open-fronted showcase refrigerated cabinet for stores.

14. The combination as recited in claim 8, wherein the at least one one-part cassette structure is attached to the open-fronted showcase refrigerated cabinet for stores via the vertical connection portion.

15. The combination as recited in claim 8, wherein the door assembly further comprises at least one two-part cassette structure comprising:

a horizontal upper frame portion and a horizontal lower frame portion, the horizontal upper frame portion and the horizontal lower frame portion being connected to each other via a vertical connection portion;

two doors supported by respective pivot bearings, the two doors each being configured to pivot about a vertical axis between a closed position and an opened position; and rails arranged substantially parallel to the side walls of the open-fronted showcase refrigerated cabinet for stores, the rails being configured to displaceably support the pivot bearings, wherein, the shelves are fixedly arranged between the at least one one-part cassette structure and the at least one two-part cassette structure.

16. The combination as recited in claim 15, wherein the rails each include a U-shaped groove configured to guide the pivot bearings.

17. The combination as recited in claim 15, wherein the pivot bearings of the two doors each include a slider which is configured to be guided in a groove of the rails.

18. The combination as recited in claim 15, wherein the two-part cassette structure further comprises a side wall on a side facing toward the cooling chamber.

19. The combination as recited in claim 15, wherein a width of the two doors is not larger than a depth of the cooling chamber.

20. The combination as recited in claim 15, wherein the at least one two-part cassette structure is attached to the rear wall of the open-fronted showcase refrigerated cabinet for stores.

21. The combination as recited in claim 15, wherein the at least one two-part cassette structure is attached to the open-fronted showcase refrigerated cabinet for stores via the vertical connection portion.

* * * * *